United States Patent [19]

Reynolds

[11] Patent Number: 4,473,172

[45] Date of Patent: Sep. 25, 1984

[54] VERTICAL ARTICLE DISPENSER

[76] Inventor: Robert L. Reynolds, 1025 44th Ave., Oakland, Calif. 94601

[21] Appl. No.: 368,918

[22] Filed: Apr. 16, 1982

[51] Int. Cl.[3] ..... B65H 1/02; B65H 3/22

[52] U.S. Cl. ..... 221/213; 221/231; 221/241; 221/267; 221/281

[58] Field of Search ..... 221/213–216, 221/227, 230, 231, 241, 247, 248, 251, 267, 281, 198; 194/DIG. 12

[56] References Cited

U.S. PATENT DOCUMENTS

| | | | |
|---|---|---|---|
| 859,853 | 7/1907 | Stewart | 221/216 X |
| 1,108,164 | 8/1914 | Glines | 194/DIG. 12 |
| 1,257,153 | 2/1918 | Turney | 221/213 X |
| 1,385,087 | 7/1921 | Matchett | 221/251 |
| 1,528,778 | 3/1925 | Millar et al. | 221/215 |
| 1,749,773 | 3/1930 | Matchett | 221/251 X |
| 1,926,436 | 9/1933 | Eldean | 221/198 |
| 1,926,931 | 9/1933 | Belli | 221/213 X |
| 2,713,441 | 7/1955 | Hutsell | 221/39 |
| 4,023,704 | 5/1977 | Pitel et al. | 221/281 X |

*Primary Examiner*—F. J. Bartuska
*Attorney, Agent, or Firm*—Robert G. Slick

[57] ABSTRACT

A vending machine for articles such as newspapers, magazines or the like is provided wherein the articles are held in a vertical plane and can be viewed through a transparent front glass and wherein a single article is dispensed at a time and wherein the operation is substantially theft-proof in that it is virtually impossible to obtain more than a single article for each payment.

4 Claims, 29 Drawing Figures

VERTICAL ARTICLE DISPENSER

SUMMARY OF THE INVENTION

Over the years various newspaper vending machines have been proposed but they have ordinarily been so complicated and unsatisfactory that most of them have not found commercial acceptance. Thus, despite the work of many inventors, the usual newspaper vending machine merely consists of a device wherein a stack of papers is available to a buyer upon the insertion of the proper coin or coins. Thus the buyer can take several papers or several individuals can take papers before the door swings closed. At the present time as newspapers are becoming more expensive, the situation becomes even more critical so it is more desirable than ever that a single paper be dispensed for each payment.

Accordingly, it is the primary object of the present invention to provide a newspaper vending machine which is relatively foolproof in operation so that it is substantially impossible to obtain more than a single paper upon each payment.

Another object of the present invention is to provide a newspaper vending machine wherein substantially the entire structure moves out of the cabinet for easy servicing and filling.

Another object of the present invention is to provide a lock whereby the pressure plate which normally pushes out the papers is retained at the rear of the machine for easy filling when the paper drawer is out.

Still another object of the invention is to provide a structure having means at the bottom of the dispensing slot so that a wide range of page thicknesses can be dispensed without adjustment of the machine, yet permitting quick, positive adjustment when there are large variations in paper thickness from day to day.

Another object of the present invention is to provide a structure wherein the paper moves straight down from its display to its vended position for at least one third the height of the paper, making it easy to dispense the papers since the papers are substantially in a "free fall" situation.

Another object of the present invention is to provide an improved ratchet drive for dispensing the papers which has a handle which cannot be pumped to push more papers out of the machine without payment for each paper taken.

A further object of the invention is to provide a money box which is well protected from theft, yet from which it is simple and fast for the operator to collect.

Another object is to provide a compact dispenser, yet one which has a large paper capacity.

Still another object is to provide a rack which is extremely durable and which has a minimum of moving and wearing parts. Also, the simple, rugged mechanism permits the rack to be sold at a price competitive with simple racks not incorporating the advantages of the present invention.

A still further advantage of the invention is to provide a pressure plate for pushing the papers forward at an almost constant pressure, regardless of whether the machine is almost full or almost empty.

Various other objects and features of the invention will be brought out in the balance of the application.

DESCRIPTION OF THE PREFERRED EMBODIMENT

Figure 1:
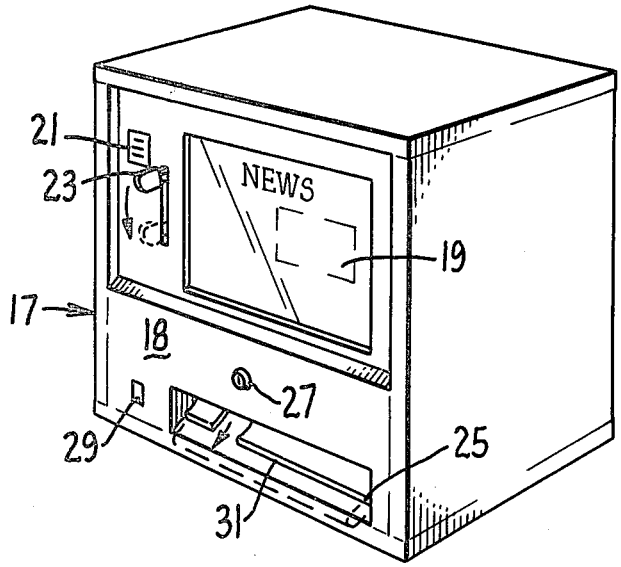
FIG. 1 is a perspective view of a machine embodying the present invention.

Referring now to the drawings by reference characters, the machine of the present invention is of generally rectangular form and has a cabinet 17 with a front panel 18 with a clear section 19 through which one can view the front page of a newspaper being dispensed. Substantially all of the mechanism is combined in a drawer-like structure which slides into cabinet 17. The machine is equipped with the usual coin slots 21 and actuating lever 23 and has a slot 25 through which the papers are dispensed. The vending machine has a lock 27 and a coin return slot 29. Visible from the top of the dispensing slot 25 is a plate with a guide 31 with upturned ends which serves to restrict access up the dispensing slot 25.

Figure 15:
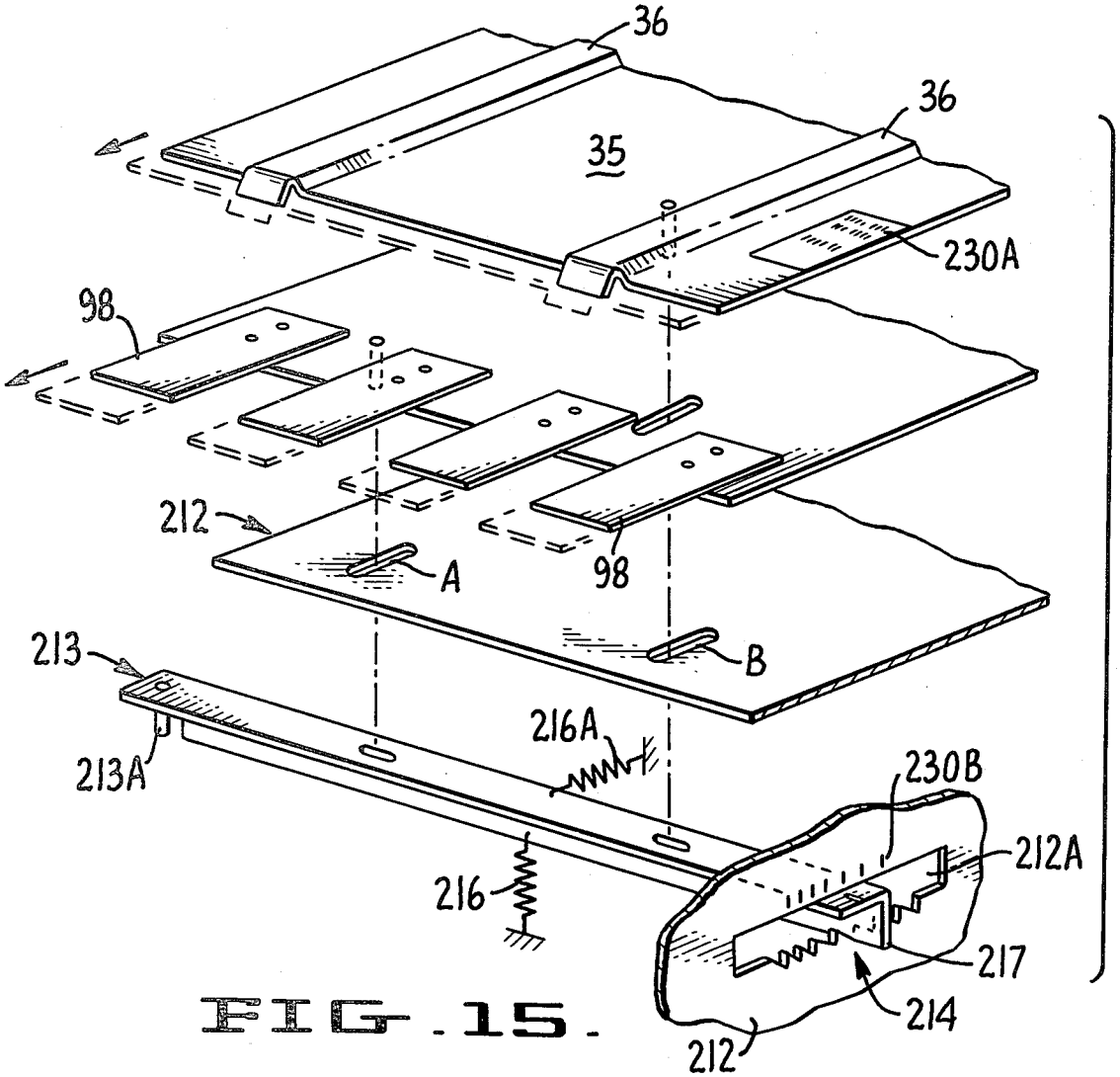
FIG. 15 is an exploded, perspective view of the paper supporting apparatus and the adjustment mechanism for changes in paper thickness.

Internally, the machine has a bottom plate 35 which can be smooth or corrugated with raised rails 36, as best seen in FIG. 15, so that the papers can slide freely over it. Preferably these rails are coated with a low friction plastic such as Teflon ®. The newspapers themselves, as at 37 and 39, are held in a folded, vertical position and are urged forward toward the front of the machine by means of a pressure plate 41 which may or may not have a forwardly extending projection 43 near the bottom. The purpose of the projection 43 is to put increased pressure near the bottom of the paper and to reduce pressure on the upper portion of the paper; this may aid in the dispensing operation but in practice it is ordinarily not necessary to employ this projection. The pressure plate 41 is attached to rod 44 which slides through slots 47 along the bottom sides of the machine. Rollers 45 on the top edges of pressure plate 41 (see FIG. 12) minimize friction should the pressure plate tilt and thus bring the rollers into contact with top rails 49 as the pressure plate pushes papers forward for delivery. Also top rails 49 and the pressure plate rollers 45 prevent the pressure plate from tipping out of position when the dispenser is opened for loading or servicing. Pressure plate 41 is urged to a forward position by means of springs 51, later described in detail.

Figure 4:
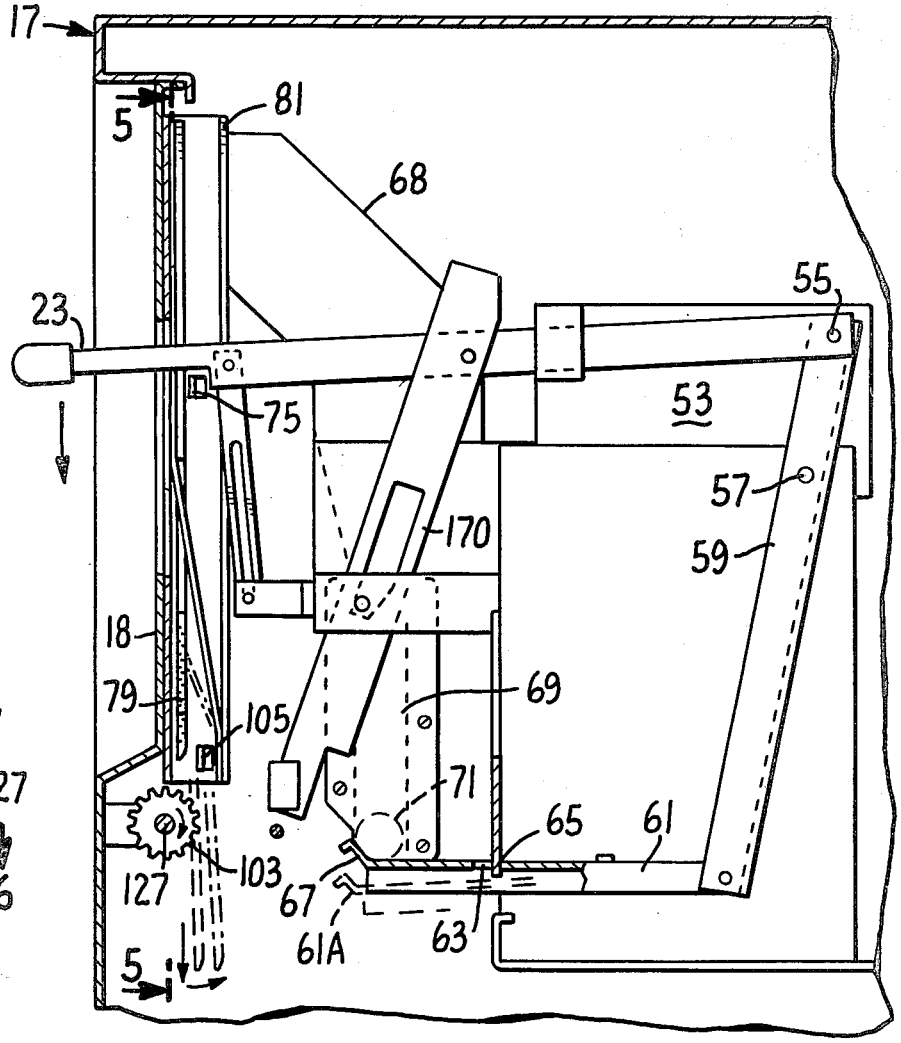
FIG. 4 is a section on the line 4—4 of FIG. 3.
Figure 6:
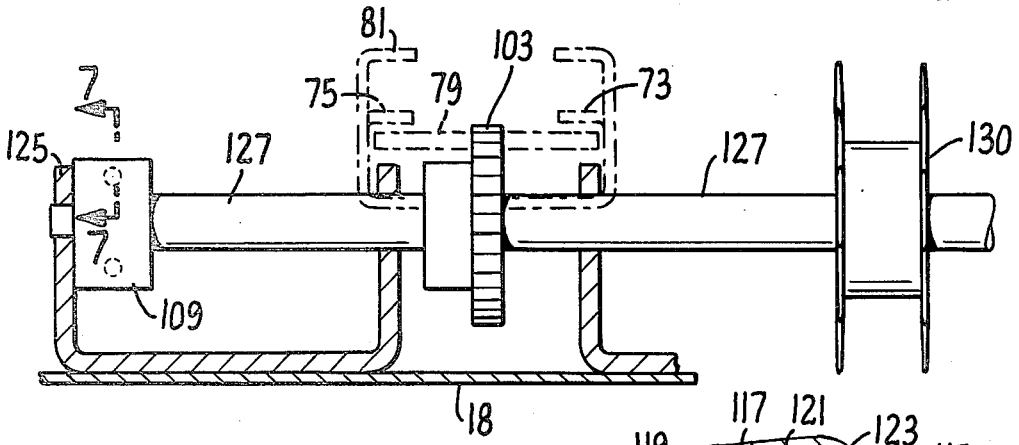
FIG. 6 is an enlarged section on the line 6—6 of FIG. 5.
Figure 8:
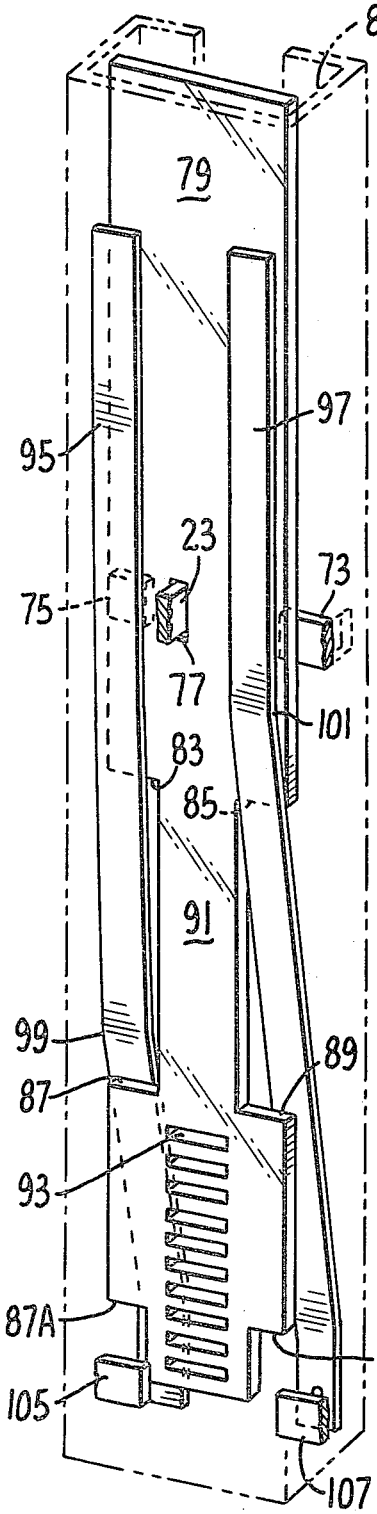
FIG. 8 is a perspective view of the rack which moves down to dispense the papers.
Figure 9:
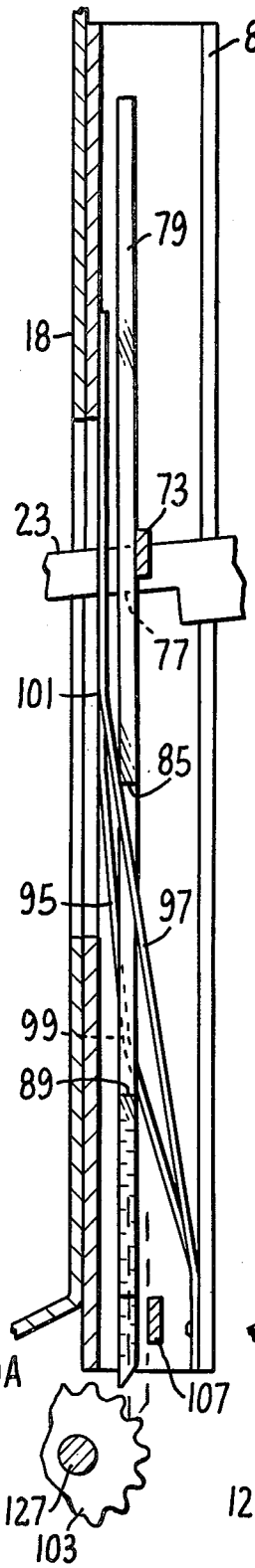
FIG. 9 is a side view of the rack showing it in an upper position, just as it has started to move down.
Figure 10:
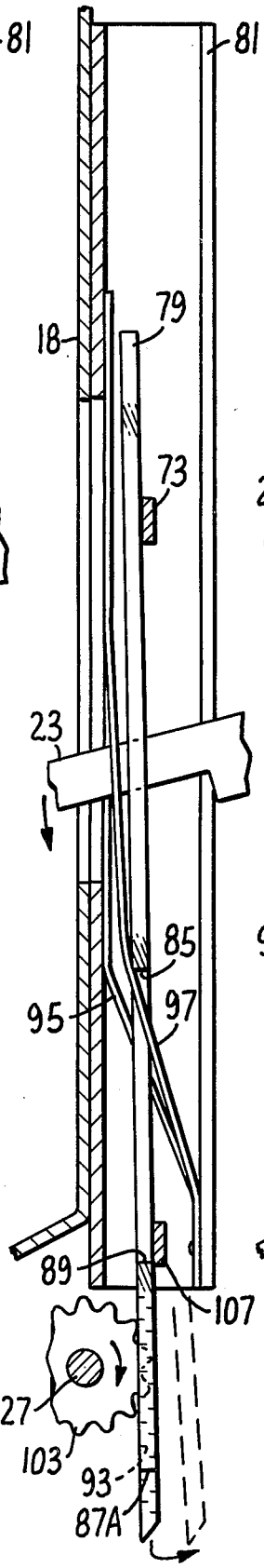
FIG. 10 is a similar view showing the rack in an intermediate position while it is dispensing a paper.
Figure 11:
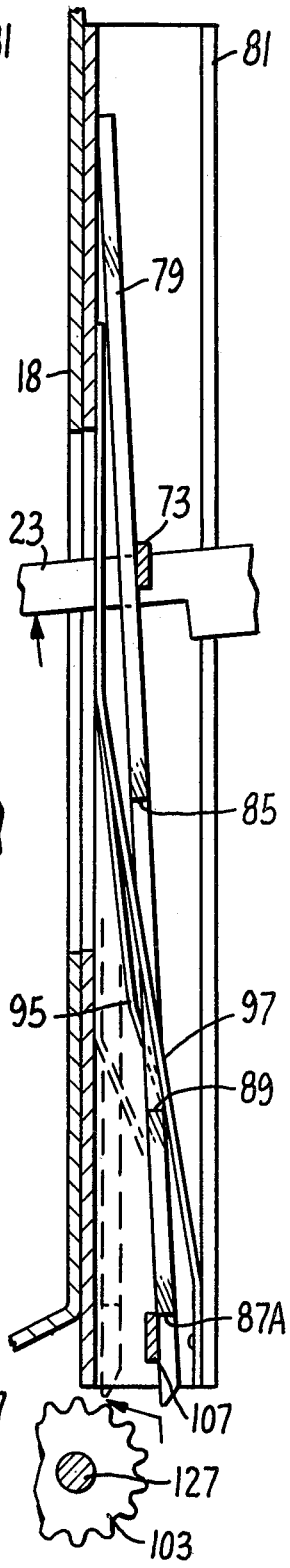
FIG. 11 shows the position of the rack as it returns to its upper position for a repetition of the cycle.

The actual release mechanism which releases the lever arm for dispensing a paper when a coin or coins are inserted, forms no part of the present invention and therefore is shown largely in diagramatic form. Referring now particularly to FIG. 4, the dispensing handle 23 is held on plate 53 by pin 55 pivoted on the frame of the machine by pin 57 which forms part of the lever arm 59. Arm 59 is pivoted to arm 61 which has a slot 63 therein normally engaged on the abuttment 65 of the frame of the machine. The terminal end of arm 61 is turned upward as at 67 to form a cam-like structure. Directly above this is the coin slot 69 and when a coin of the proper denomination falls into this slot (the guide directing the coin into the slot is shown at 68) it falls upon the end of arm 61. The coin is shown in phantom at 71. Arm 23 is normally prevented from moving downwardly by the engagement of slot 63 on abutment 65. Rack 79 serves as a guide for arm 23. The arm 23 passes through a slot 77 in the rack 79 which is adapted to slide up and down in the housing 81 guided by arms 73 and 75 and 105 and 107. The rack 79 serves to dispense papers on its downward movement as is later explained in detail. As a coin 71 falls through slot 69 it rests on the end of arm 61. It is apparent that any movement to the right in FIG. 4 will have a camming action, causing bar 61 to move downward into the position shown at 61A in phantom lines. In this position, slot 63 has become disengaged from the abutment 65, freeing the lever arm 23. Now with the parts in a free moving position, the lever arm 23 is free to act upon rack 79. Rack 79 has upper shoulders 83 and 85 and middle shoulders 87 and 89 connected by a narrow tongue 91. Toward the bottom of rack 79 are two lower shoulders 87A and 89A. The lower portion of rack 79 has a series of rack teeth 93 therein and they engage pinion 103. Pinion 103 is fixed to shaft 127 while a one way clutch 109 is attached in a fixed position at the end of shaft 127 on arm 125 as is later described. Two leaf springs 95 and 97 are fastened near the bottom of the housing 81. Spring 95 has a bend 99 near its lower portion while spring 97 has a similar bend 101 near its upper portion. Spring 95 is brought back between the shoulders 83 and 87 while spring 97 is brought back between the shoulders 85 and 89. However, as is best shown in FIG. 8, the lower portion of spring 95 urges the rack 79 forward since it is bearing upon the shoulder 87. At the same time, spring 97 is bearing on the shoulder 85 urging it to the rear. However, with the rack in its upper position, it is apparent that the forward force is stronger, because the bend on spring 95 is designed to urge the rack forward in this position so that as the rack moves down, it will pass in front of arms 107 which will cause the rack to be held against pinion 103 and cause such pinion to be rotated as is best seen in FIG. 10. Now as the arm 23 gets to the bottom of its stroke, the force gets greater from spring 97, urging the rack to the rear but actual movement is prevented by the stops 107 until the shoulders 87 and 89 clear the stops. At this point, rack 79 swings to the rear as is shown in FIG. 11, disengaging from pinion 103 where it can move to the top position for a repetition of the cycle. It should be noted that the stops 105 and 107 and shoulders 87A and 89A are so designed that the rack will not position for recycle until after arm 61 has returned past abutment 65. Thus, coins must be inserted to recycle the rack.

Figure 7:
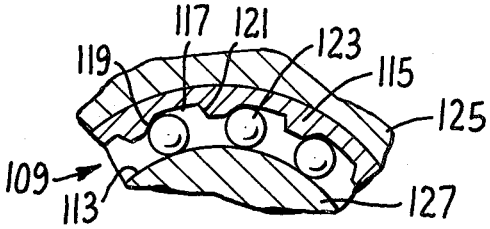
FIG. 7 is an enlarged partial section on the line 7—7 of FIG. 6.

It was previously stated that shaft 127 is provided with a one way clutch 109. The internal structure of this clutch is shown in FIG. 7. The shaft 127 on which the clutch 109 is mounted forms a smooth inner race. The outer race 115 has a plurality of notches 117, each of which has one sloping side as 119 and one substantially radial side 121. Rollers 123 fit between the races. As can been seen from FIG. 7, if one attempts to rotate outer race 115 a roller 123 will tend to wedge on the ramplike member 119, locking the races together. On the other hand, if one reverses the direction of rotation, the rollers will be engaged by elastic keepers (not illustrated) against walls 121 whereupon they will merely rotate rather than wedge and thus one race is free to turn relative to the other. Thus, when the rack 79 has its teeth engaging pinion 103, the rack can move downward only, as the clutch 109 prevents reverse rotation. At the end of the stroke, as shoulders 87 and 89 pass arms 105 and 107, spring 97 moves the rack out of contact with the pinion so that lever 23 can be raised for a repetition of the cycle.

As stated above, pinion 103 is fixed to rotatable shaft 127 so that the rotation of shaft 127 is locked to the rotation of pinion 103. The rotation of shaft 127 serves to dispense the papers, as later described in detail. It is believed apparent that one could not jiggle the handle 23 and cause the shaft 127 to reverse direction for a repetition of the stroke so that more than one paper would be delivered for the price of a single purchase. Thus the action is substantially foolproof since pinion 103 prevents the rack 79 from moving up when the latter is in its forward position.

Furthermore, by fixing the shaft 127 to the rack 79 through pinion 103, a customer cannot move the handle 23 part way down, just enough to grab a paper, and pull out the paper without rotating the shaft 127 and thereby pulling the rack 79 through its operating cycle. This is because the pins mounted on shaft 127, to be described below, penetrate the paper and pulling out the paper will cause the shaft to turn. If the rack 79 is held in place by firmly holding handle 23 so it cannot move down, when the paper is pulled out the pins mounted on shaft 23 penetrating the paper will tear the front section several pages deep. Accordingly, this design discourages the attempting to take two papers for the price of one. Also, the amount of paper travel can be reduced by shortening the rack.

It was previously mentioned that the rotation of shaft 127 serves to actuate the dispensing mechanism. Shaft 127 carries a plurality of pinwheels 130, 132 and 134. Each of these wheels has a plurality of pin like spikes 135 extending in a radial direction, the spikes being sufficiently stiff to penetrate a newspaper and pull it down against the action of the pressure plate 41 and the spring 98 but are so small that they do not substantially mar the paper. In one embodiment of the invention there is less separation between the wheels 130 and 132 than between 132 and 134. The reason for this is that the fold of the paper is on this side of the machine so that more force is needed and can be exerted on the left than on the right side of the paper. Now as the paper moves downwardly, it encounters a light, flexible barrier sheet of metal or other material 136 which extends across the entire front of the dispensing slot and which normally prevents one from reaching up in the slot in an effort to dislodge a paper. As shaft 127 continues to turn, the paper passes downwardly into the position shown in phantom at 138 (FIG. 2) whereupon it can easily be grasped and pulled out by the buyer. It will be noted that one feature of the present invention is that the movement of the paper is straight down to about the position shown at 140 so that gravity assists in dispensing the paper, especially larger papers. Ordinarily the paper travels about one third of its height before it is curved around to come out of the slot 25. This is in contrast with prior art machines where the paper ordinarily makes a sharp turn immediately after being disengaged from the wheels propelling the paper.

Figure 2:
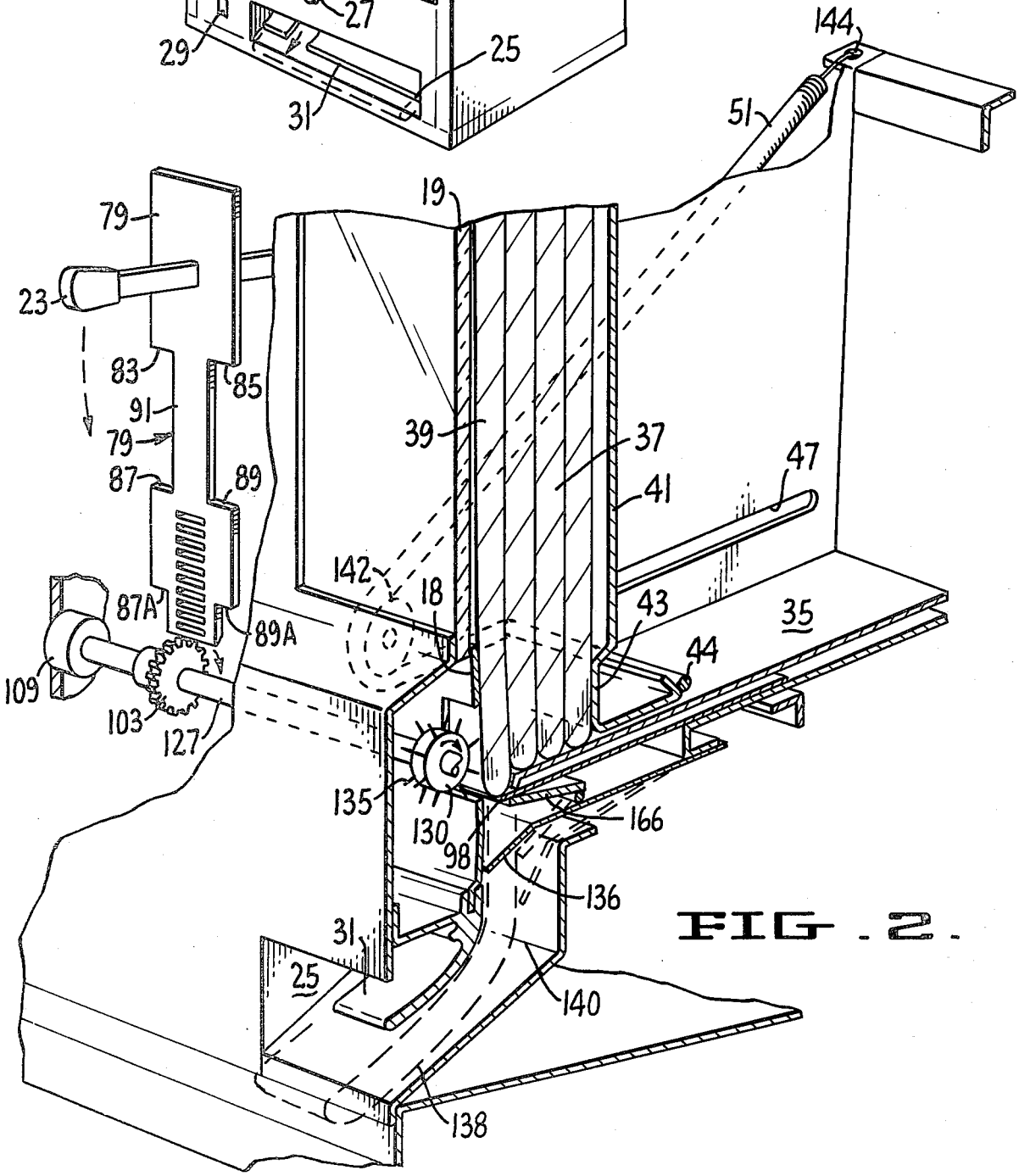
FIG. 2 is an enlarged view, partly in section, of the paper dispensing mechanism.
Figure 3:
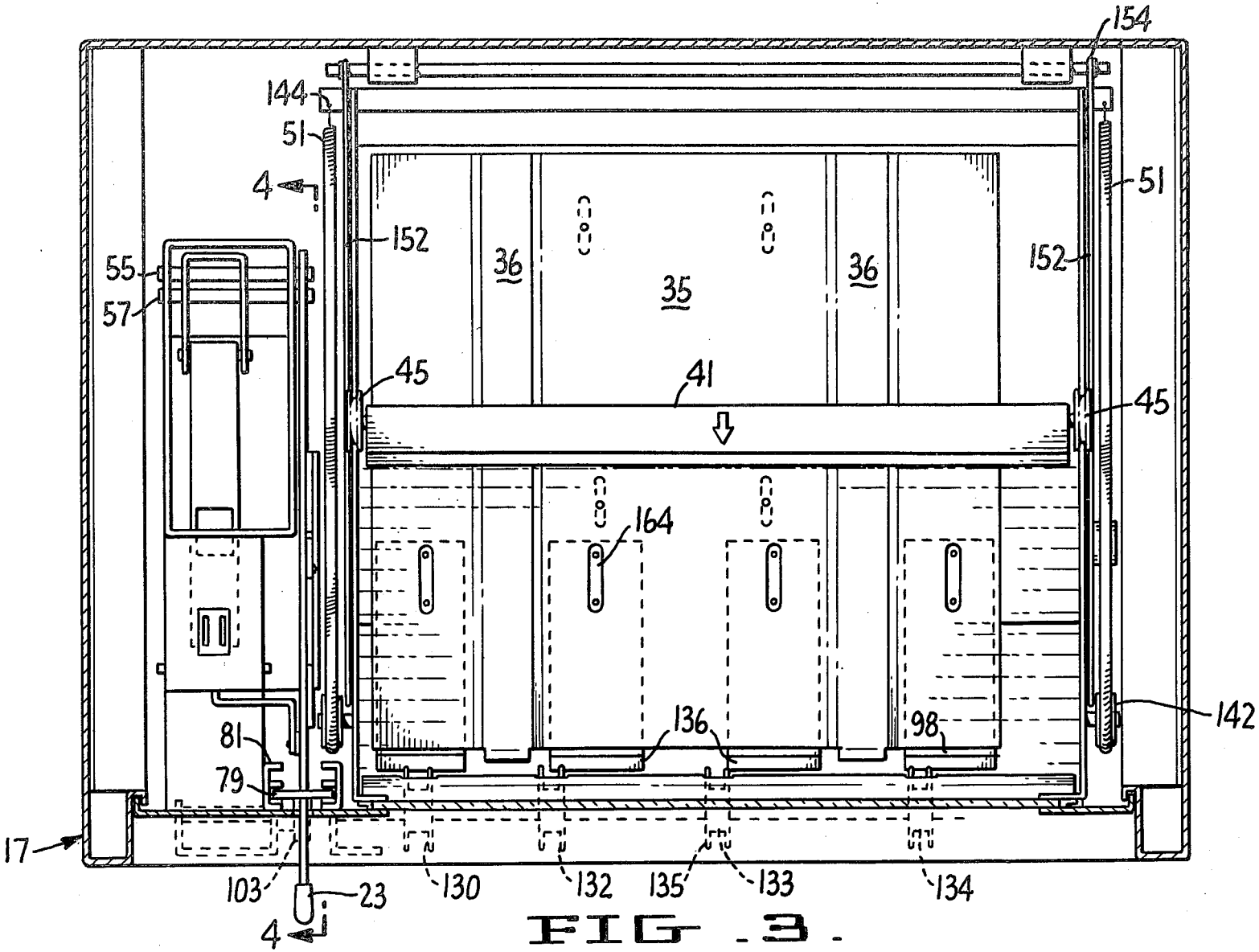
FIG. 3 is an enlarged plan view of the paper dispensing mechanism with the cover removed.
Figure 5:
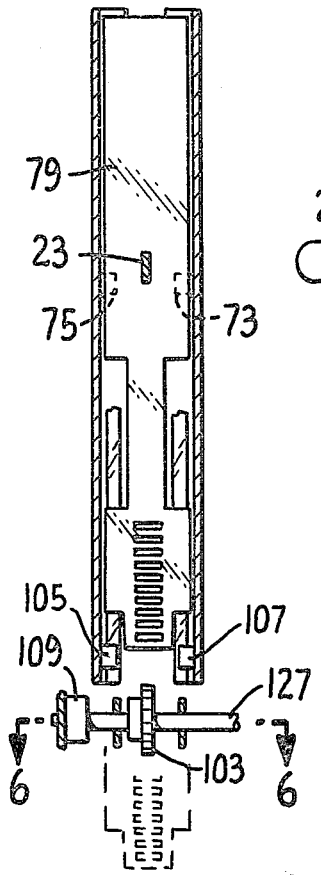
FIG. 5 is a section on the line 5—5 of FIG. 4.
Figure 22:
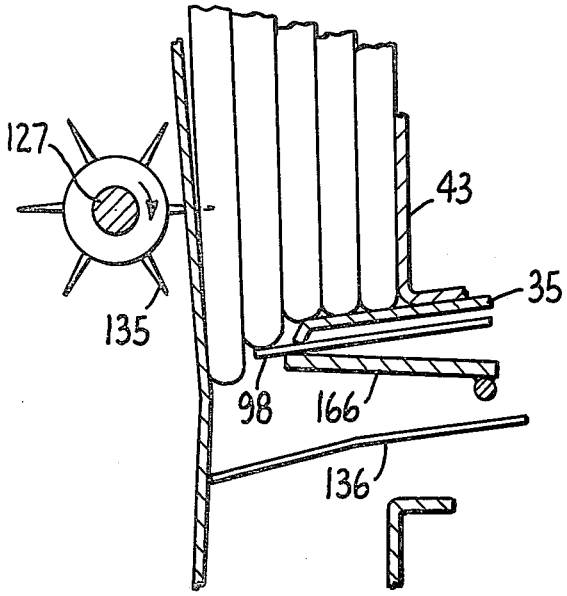
FIG. 22 is a side view, partly in section, of the paper dispensing mechanism showing position of the parts prior to the start of a dispensing operation when thin papers are in the machine.
Figure 23:
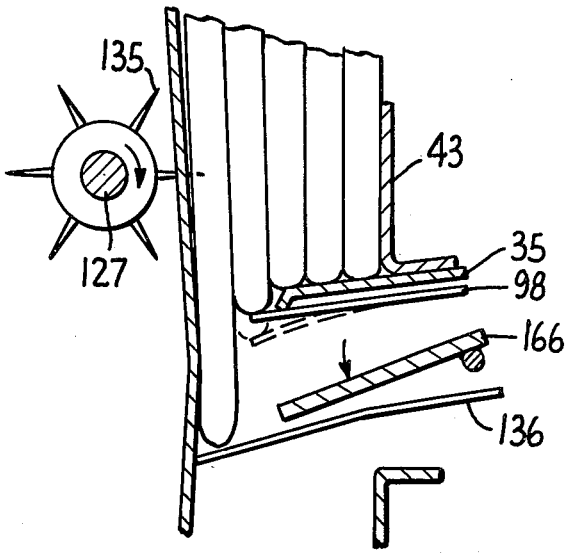
FIG. 23 is a similar view showing the position of the parts and flexing of the metering spring during a dispensing operation.
Figure 24:
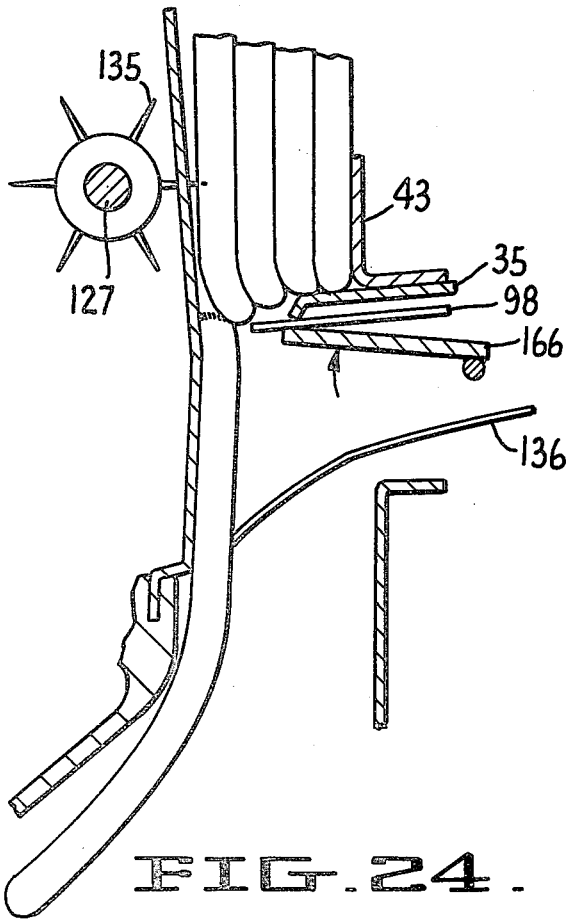
FIG. 24 is a similar view showing the position of the parts just as one paper has been dispensed.
Figure 25:
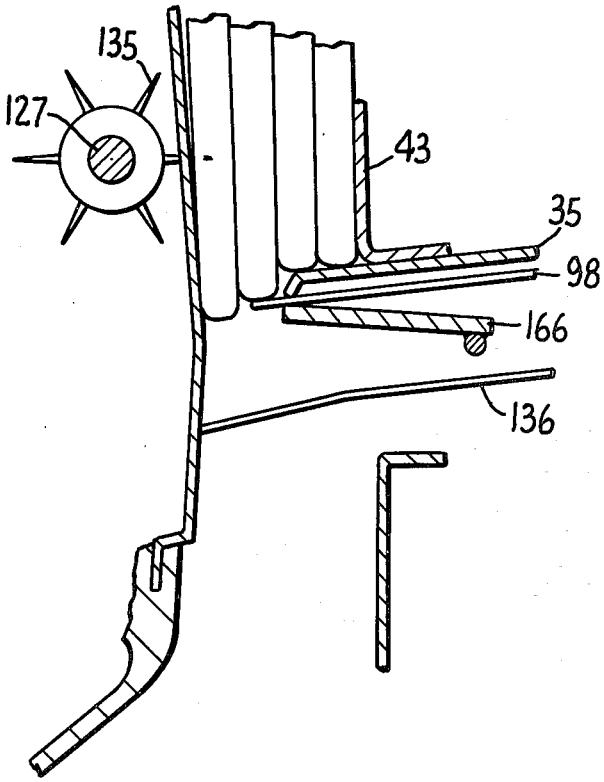
FIG. 25 is a view, similar to FIG. 22, showing the position of the papers after one of the papers has been dispensed.
Figure 26:
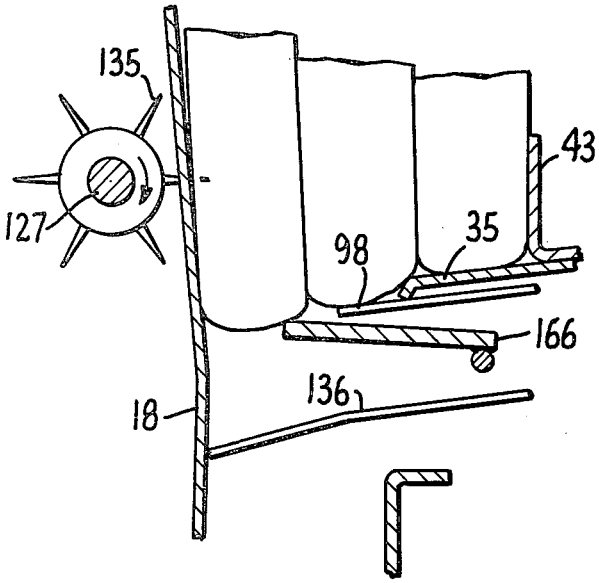
FIG. 26 is an enlarged side view in section, showing the position of the parts prior to dispensing very thick papers.
Figure 27:
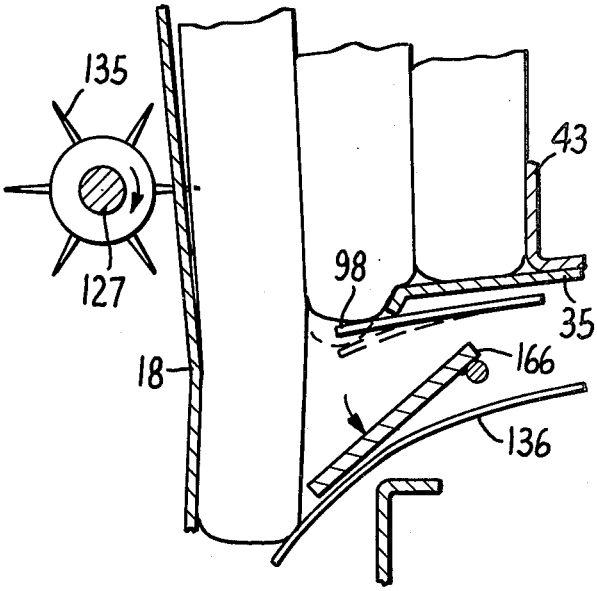
FIG. 27 is a similar view, showing the position of the parts just as the dispensing operation commences.
Figure 28:
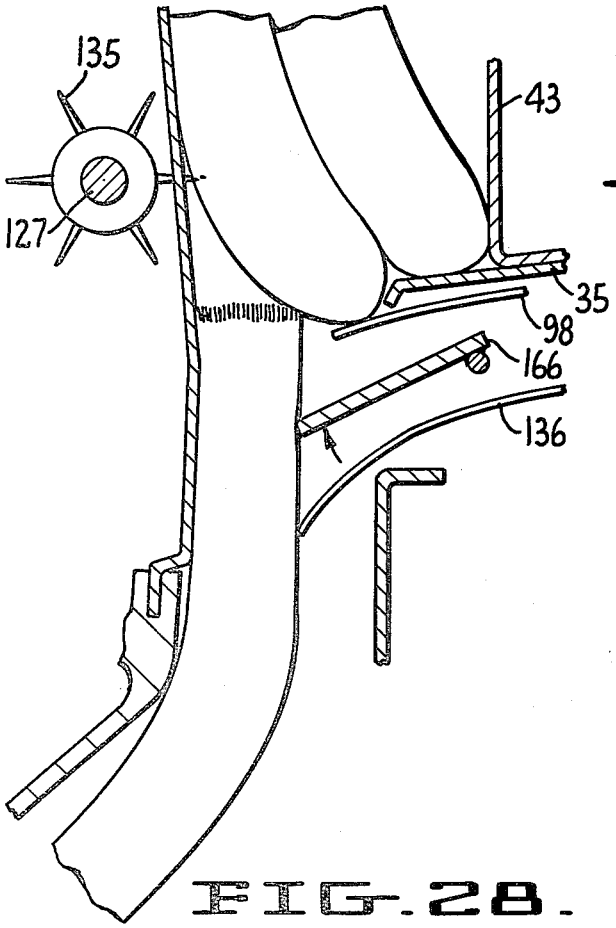
FIG. 28 is a similar view, showing the position of the parts just as the dispensing operation is completed.
Figure 29:
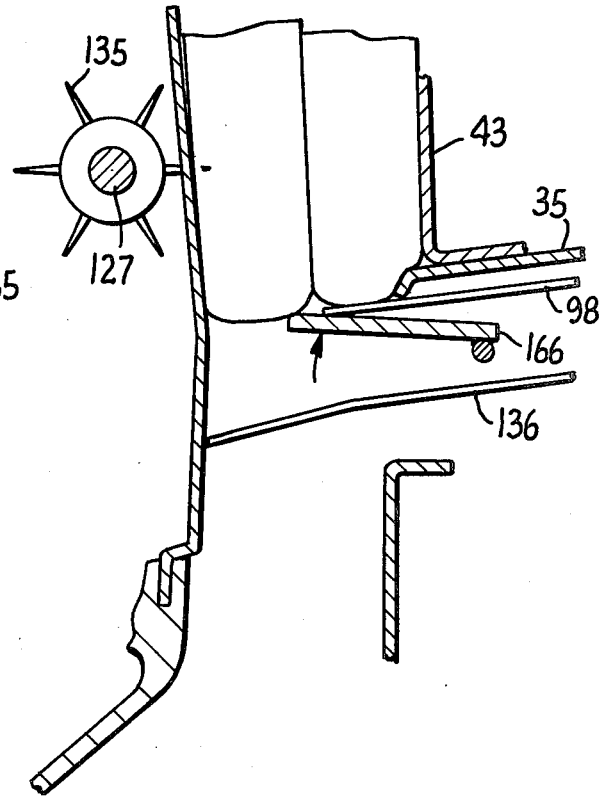
FIG. 29 is a similar view, showing the position of the parts after the operation has been completed and the papers are in position for a repetition of the cycle.

A novel mechanism controls the delivery of papers one at a time. It was previously mentioned that the papers rest on the floor 35 and are urged forward against the glass by backing plate 41 as shown in FIG. 2. The rotation of shaft 127 serves to actuate the mechanism. The lead paper, next in position to be delivered, may rest on spring 98 (FIG. 12), may rest on support plate 166 (FIG. 26), or may be suspended against the glass solely by friction (FIG. 22), depending on paper size and setting of the adjustment system to be described below (see FIGS. 12, 26 and 22). As will be explained, the interaction of spring 98, plate 166 and the flat front face enable the dispenser to deliver a range of paper thicknesses, one at a time, without adjustment. With this system many newspapers could use this vendor without ever changing the adjustment setting so long as their page thickness variations fall within the vendor's delivery range at that setting.

Figure 19:
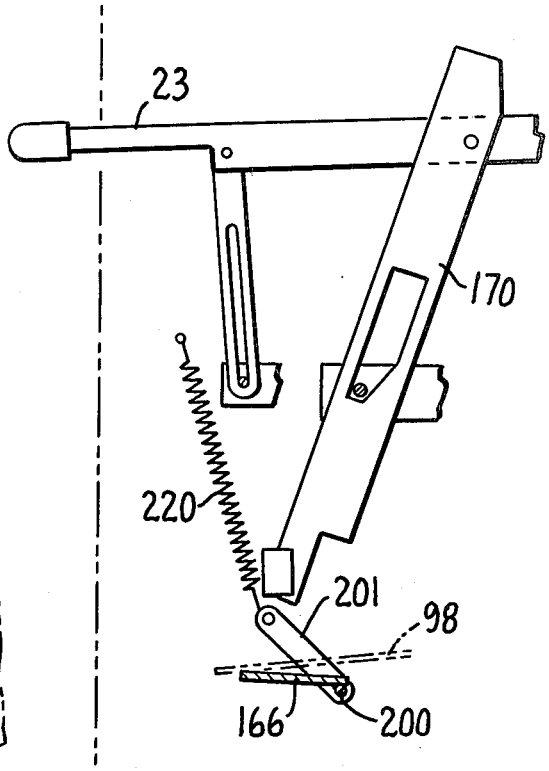
FIG. 19 is a side view of the mechanism shown in FIG. 18, showing the position of the parts at the start of a dispensing operation.
Figure 20:
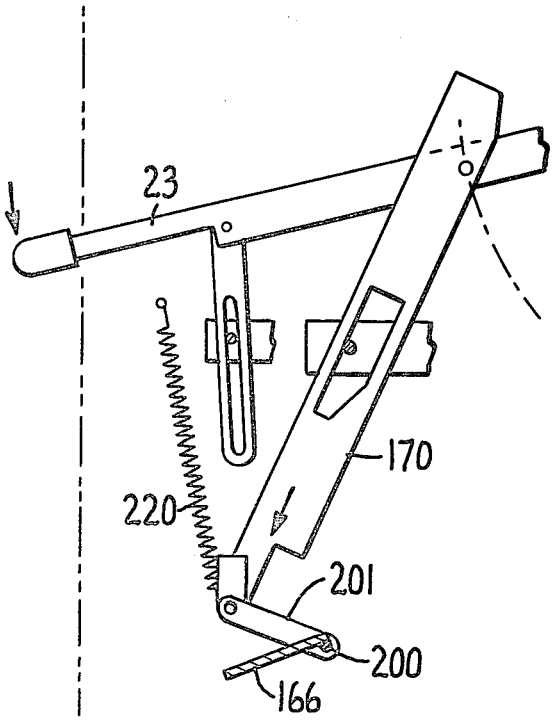
FIG. 20 is a similar view showing the position of the parts during the dispensing operation.
Figure 21:
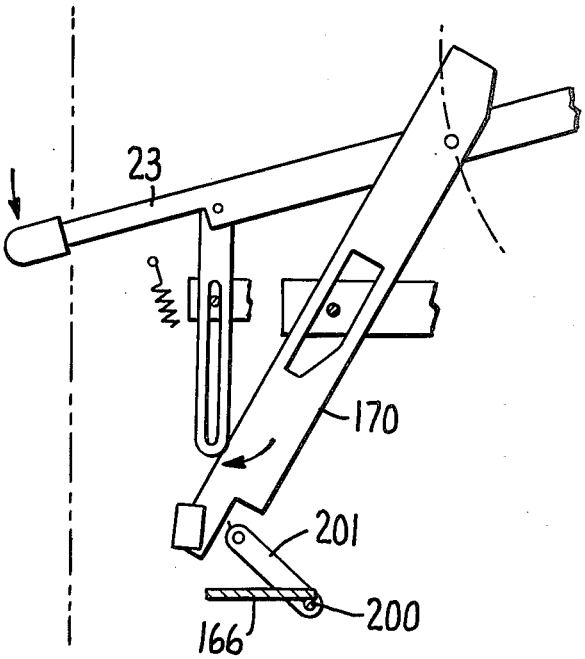
FIG. 21 is a similar view showing the position of the parts just at the completion of a dispensing operation.

To dispense a paper, insert proper coins and depress handle 23. As handle 23 is depressed (see FIGS. 18–21), the arm 170 extending from handle 23 will engage crank 201 on shaft 200 and force the plate 166 open against the tension of spring 220 that keeps it up against the bottom of spring 98 (FIG. 19). Immediately after plate 166 begins to open, rack 79 will engage the pinion 103 causing the shaft 127 to rotate and move the lead paper down the paper chute 25 between the flat face and spring 98. If spring 98 extends under the paper to be delivered, the paper coming down will depress spring 98 enough so it can pass. The next paper to be delivered may start down also. It can travel as far as spring 98 which will stop its travel and hold it in place for the next delivery. FIGS. 22–25 and 26–29 show this sequence with thin and larger papers, respectively. In the delivery of larger papers, the floor 35 serves the same function as spring 98 and the rotation of shaft 127 will drive out only one paper at a time. As handle 23 nears the bottom of its stroke, arm 170 disengages crank 201 and the plate 166 snaps up to support spring 98 and any papers resting thereon.

As can be seen in FIGS. 22–29, as spring 98 is depressed the opening between the spring 98 and the flat face 18 increases. To control the delivery of very thin papers, this opening should develop very slowly. This requires the axis of spring 98 to be close to a right angle to the flat face with which it interacts. On the other hand, to optimize the delivery range of larger papers, the included angle between spring 98 and the flat face should be more than 90 degrees so that the size of the opening will increase faster as spring 98 is depressed.

The thinnest paper deliverable, one at a time at any position setting of spring 98, will be that size which will pass spring 98 and spring 98 will retain the second paper to keep it from passing. For thinner papers, the thinnest deliverable size one at a time will be approximately equal to the thickness of the opening between the flat face and spring 98 unflexed. When set to deliver thicker papers, the thinnest deliverable thickness, one at a time, will be less than the thickness of the opening between the flat face and spring 98 unflexed, but never less than about one-half of such opening. The smallest papers deliverable at any setting deliver more easily because they tend to "free fall." At any setting, as the papers get thicker, the resistance of spring 98 increases, increasing the effort required to deliver and pull out a paper from slot 25.

The thickest paper deliverable at any setting is determined by the maximum opening a delivering paper can force between the depressed spring 98 and the flat face. The real limiting factor is the increased tension on the delivering paper by spring 98. This tension will increase to the point that the paper may become too difficult to pull out in commercial application.

In order to increase the utility of spring 98, the bottom plate 35 extends over spring 98 to carry as much of the weight of the papers waiting to be delivered as possible. The opening between the bottom plate 35 and the flat face 18 will be at least as large as the largest paper deliverable at the companion opening for the spring 98 and such flat face.

The support plate 166 shown in FIG. 2 is required to support spring 98 so that larger, heavier papers can be loaded without falling out the paper chute 25. The support plate also keeps larger papers from falling through the opening while waiting to be delivered. The support plate 166 is essential to the delivery of the larger, heavier papers, and improves the operating range of page thicknesses that can be handled at any one setting. Plate 166 is optional for the delivery of thin papers.

Figure 16:
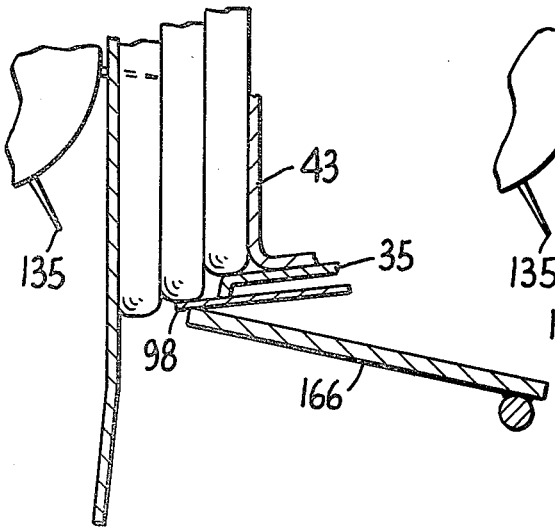
FIG. 16 is an enlarged, partial, sectional view of the paper dispensing mechanism showing the position of the parts when thin papers are in the machine.
Figure 17:
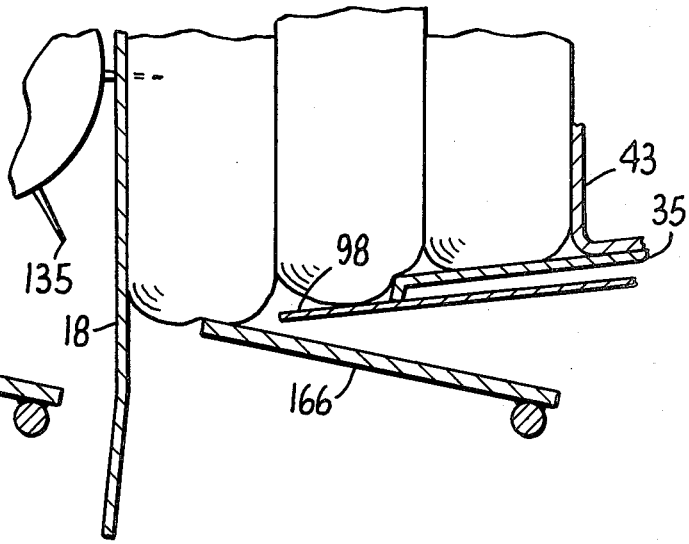
FIG. 17 is a view similar to FIG. 16 but showing the position of the parts with thick papers.
Figure 18:
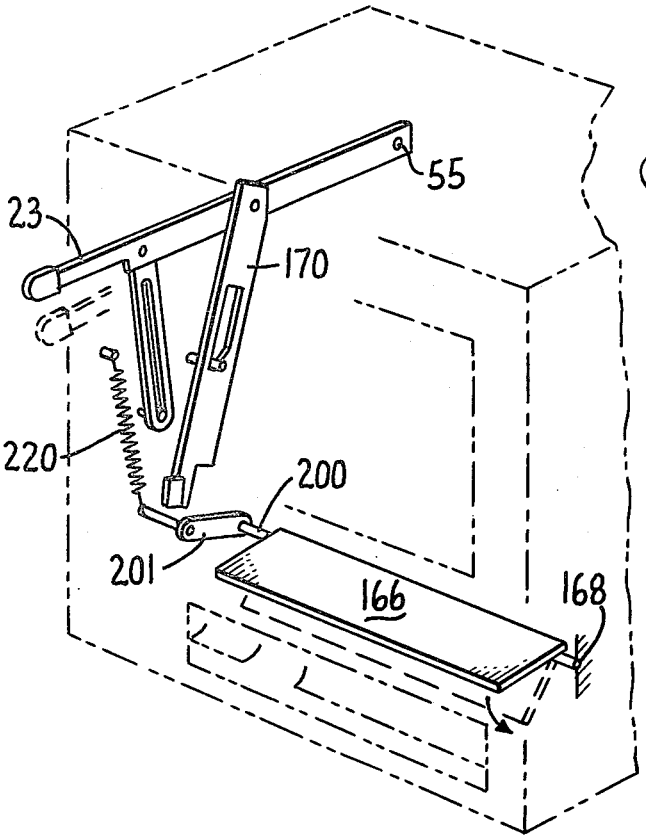
FIG. 18 is a perspective view of the dispensing lever showing the motion of the theft preventing plate which also serves to control the delivery of larger papers.

Because of the delivery characteristics described above, the adjustment system shown in FIGS. 15, 16 and 17 has been devised. With this system those users whose page thickness variations exceed the performance capability at a single setting can quickly and accurately adjust the dispenser for the page thicknesses they wish to deliver. This design takes into account the requirement that the bottom plate open at a faster rate than the spring 98. To accomplish this the spring 98 and bottom plate 35 are mounted on a base plate 212 in such a way that they can be moved in and out from the flat face by lever 213. The base plate 212, which is attached securely to the structure, provides the pivot point 213A for the lever arm 213 and has elongated slots for the guide and drive pins that extend down through the base plate from the spring 98 and bottom plate 35. To provide for the different rates of travel for the spring 98 and bottom plate 35, they are attached to the lever arm 213 by drive pins at points A and B, respectively, as shown in FIG. 15. As can be seen from FIG. 15, moving the lever arm 213 will move the spring 98 and the bottom plate 35 in or out from the flat face at different rates. In order to maintain the spring 98 and bottom plate in a uniform position at each setting, and to spring loaded lever 213, springs 216A connect the drive pins extending through the lever 213 to the rear edge of the base plate 212.

To latch arm 213 in place, plate 214, having a serrated edge, is attached to wall 217. Arm 213 interacts with stop 215, and is held against stop 215 by spring 216 (see FIG. 15). The position of the arm 213 can be easily determined by where it intersects a table of settings 230A viewed from top of paper compartment looking down on the righthand side of the bottom plate 35, or, if the dispenser is loaded, by viewing the table 230B just above where arm 213 extends through wall 217. To change a setting, raise arm 213 to disengage the serrated edge and move to the desired setting as shown by a table supplied with the machine. The table indicates the approximate range of page thicknesses that can be delivered at each setting.

In practice, moving the bottom plate 35 at a faster rate than spring 98 is not absolutely necessary, and by having spring 98 attached in a fixed position to the underside of bottom plate 35 so that they move together, a simpler machine may be produced.

One feature of the present invention is the novel springing arrangement whereby the pressure plate 41 is moved against the back of the stack of papers to keep them upright and in order. In the past, attempts have been made to employ a single spring for this purpose but since the stress is proportional to the strain, the force is too great when the spring is fully compressed at the rear of the machine and too light as the last few papers are being dispensed. In the present invention this situation is obviated by employing a pair of springs, each of which is approximately twice as long as the thickness of a stack of papers. This minimizes the difference in tension when the machine is filled as contrasted with when the machine has one or a few papers in it. This is achieved by providing a pair of rollers 142 located on the forward frame of the machine. Spring 51 has one end hooked at point 144 on the back of the frame of the machine, passes forward over the roller 142 which is again fastened to the frame of the machine and then extends backward toward the rear of the machine to engage the rod 44 as is shown at 146, FIG. 12. Thus it will be apparent that as the backing plate 41 moves back and forth, the percentage variation in the length of the springs 51 is only half that of the movement of the rod 44. Thus, substantially even tension on the paper at the face is maintained at all times regardless of whether the machine is almost full or almost empty of papers. The objective of the slope of bottom plate 35 and springs 51 is to maintain uniform pressure on lead papers.

Figure 12:
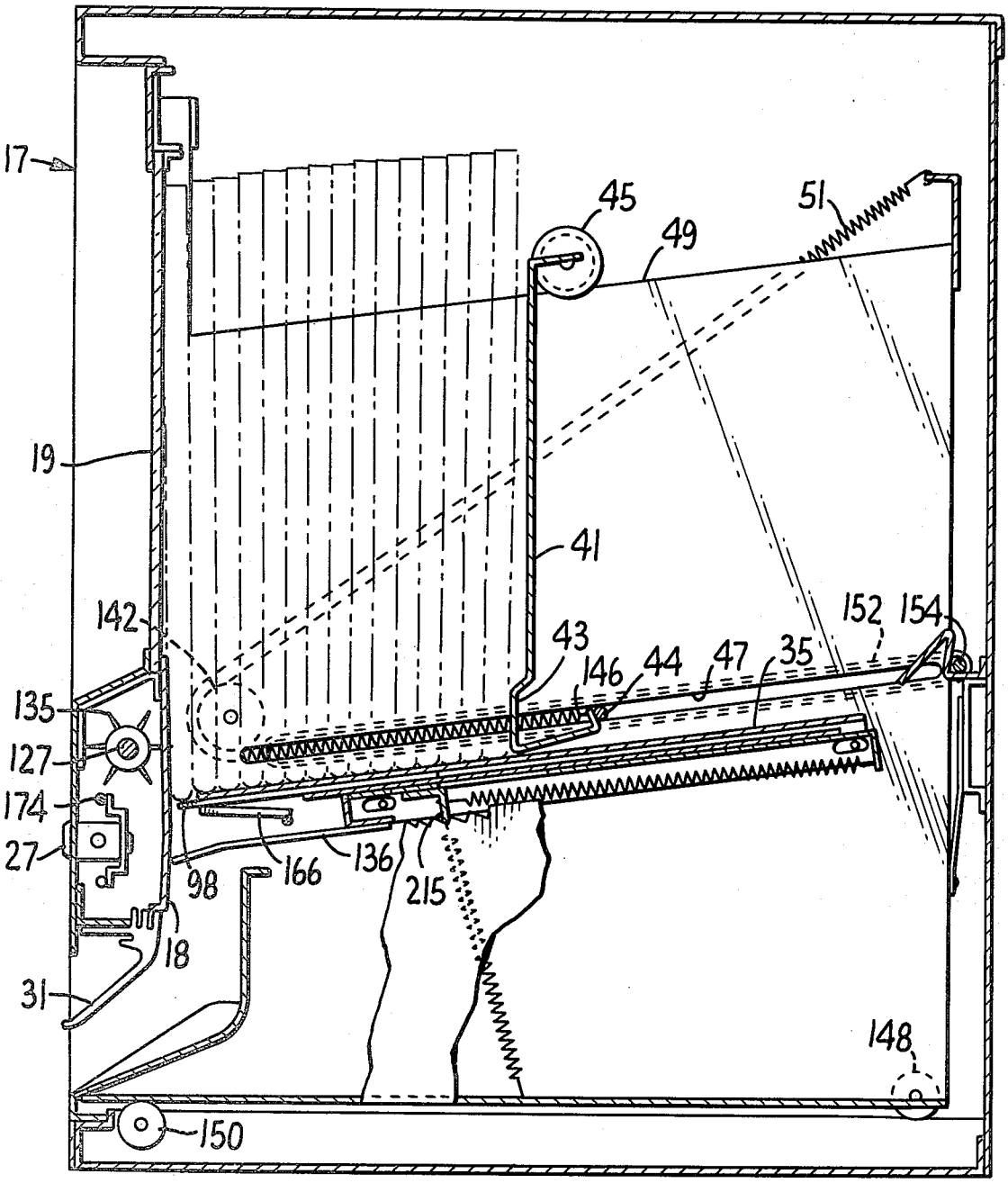
FIG. 12 is a side view, in section, of the paper dispensing machine.
Figure 13:
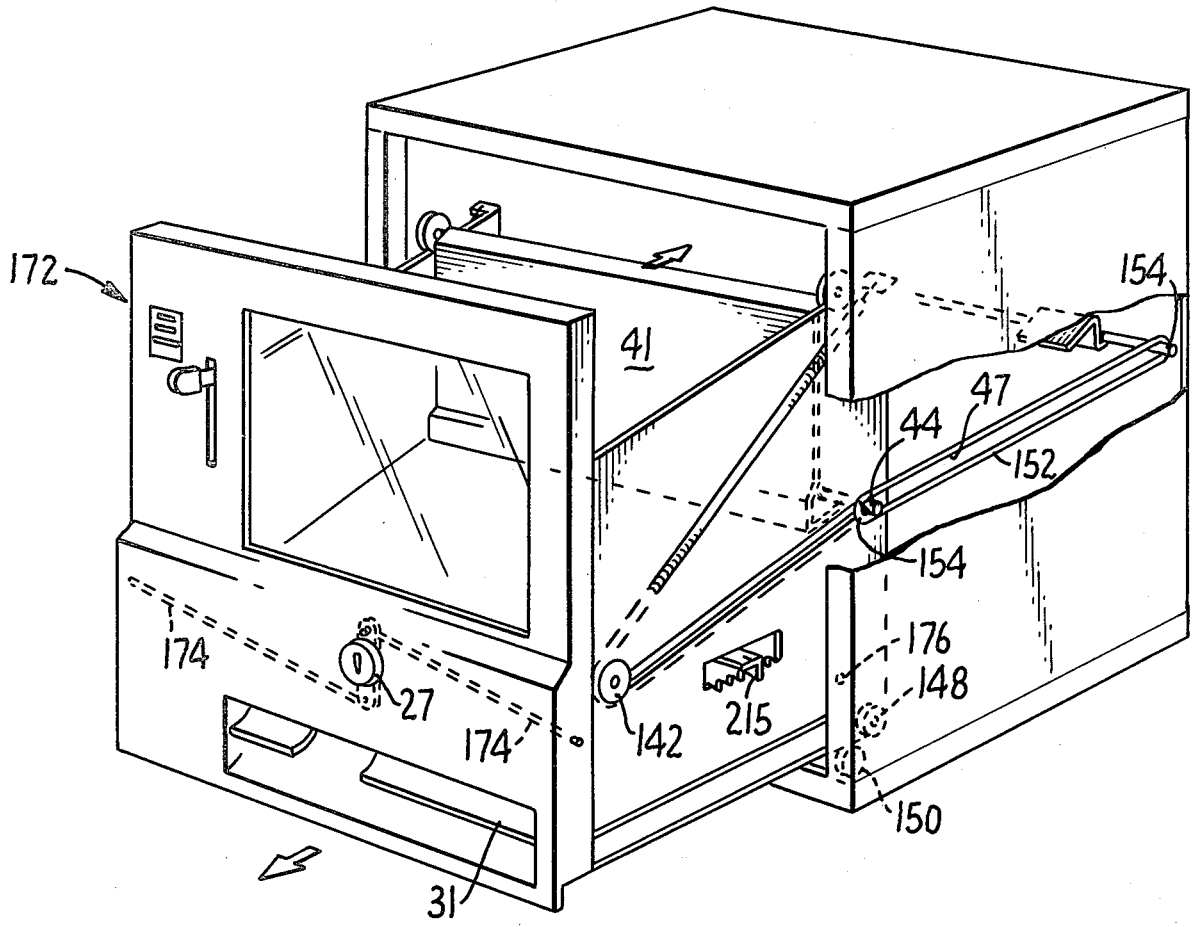
FIG. 13 is a perspective view of the machine showing the drawer pulled out for loading.

Another feature of the machine is that substantially the entire assembly of the machine is mounted on slides or rollers so that it can easily be pulled out of cabinet 17 for servicing, loading the magazine with papers or emptying the coin box (FIGS. 12 and 13). This can be achieved by having rear rollers 148 mounted on the frame of the hopper and having forward rollers 150 mounted on the forward part of the frame so that the rollers are such that the whole magazine assembly can move out when unlocked as later described. Instead of the rollers shown, one may use ordinary drawer slides. Also, the drawer is removable and interchangeable.

Normally if one moved the empty drawer out for loading papers, plate 41 would be at the front of the paper magazine, making it difficult to load the papers. To obviate this the looped rods 152 (FIG. 13) are provided on each side of the machine, the rear portion of the rods being looped over a rod 250 at point 154 and the front portion being looped over rod 44. Rod 44 is free to slide within the slot formed by the two sides of the restraining rods 152 until it gets to the end 154 of the slot so formed. It is believed apparent that when the machine is in the closed position, the rod 44 is free to slide so that the pressure plate 41 can do its job in keeping the papers upright and pushing them into the dispensing position. However, if now, one pulls open the drawer-like paper magazine as is shown in FIG. 13, rod 44 will engage at point 154 on each side of the machine so that the backing plate 41 will be retained at the rear of the paper magazine making it easy to load the papers into the machine. To remove the drawer from the housing, the rod 250 must be raised to clear latch 251 (FIG. 13).

Figure 14:
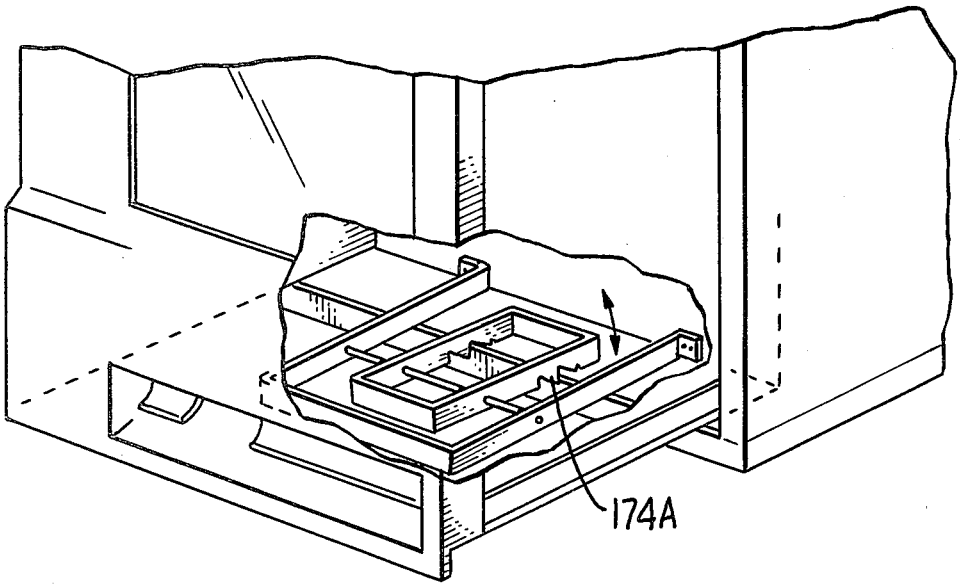
FIG. 14 is a partial perspective view showing the locking mechanism for locking the drawer in an outward position while the machine is being filled.

It was pointed out previously that one feature of the present invention is that substantially the entire mechanism can be pulled out like a drawer for loading the machine and can be removed for servicing all of the mechanical parts. The drawer is interchangeable. This is best seen in FIG. 13. The cabinet-like frame 17, previously described, accommodates the paper dispensing mechanism generally designated 172. The lock 27 is connected to two rods 174 and the ends of these rods normally engage holes 176 in the frame of the machine. When the lock 27 is turned rods 174 are drawn in so that the drawer can be pulled out of the machine as is shown in FIG. 13. As is shown in FIG. 14, as the drawer is pulled out against the force of springs 51, ratchet 174A catches the frame of the machine, so that the drawer will stay out while the machine is being loaded. The ratchet is raised when it is desired to return the drawer.

Vandals frequently attack vending machines by inserting screw drivers into various slots or spraying paint from pressure cans into slots. One feature of the present machine is that it is very difficult to vandalize since the rack which actuates the dispensing pinion is well protected from the outside. This relationship is best seen in FIGS. 8–11 wherein it is seen that the rack teeth proper 93 are connected by a long tongue 91 to the balance of the rack plate and that the lever 23 which actuates the rack through slot 77 is well displaced from the teeth. Thus, the front plate 18 entirely covers the rack itself so that one cannot insert a screw driver or the like through the slot in which lever 23 moves and interfere with the action of the rack.

Many variations can be made in the specific structure described without departing from the spirit of this invention.

I claim:

1. A vending machine having in combination:

(a) a hopper for holding a plurality of articles such as newspapers in a vertical position, (b) spring means acting against a pressure plate for pressing said articles to the front of the machine, (c) a discharge slot at the front of said machine, said discharge slot having sides substantially equal to the thickness of an article and a width equal to the width of an article, (d) means for releasing the foremost article at the front of said machine, (e) said machine including a plurality of pinwheels mounted for rotation on a shaft near the bottom edge of said plurality of articles wherein said pinwheels engage the foremost article and having means to permit said pinwheels to rotate in one direction to discharge papers and having means to prevent reverse rotation, (f) rotating means for said pinwheels to propell the foremost article into said slot, (g) said rotating means including a hand actuated lever and a rack actuated by said lever, and a pinion mounted on said shaft to rotate said pinwheels, said lever being movable from a first position to a second position, said movement engaging said rack and pinion thereby rotating said pinwheels and means for disengaging said rack from said pinion at the completion of a discharge operation allowing said lever and said rack to move back to said first position for a repetition of said operation, said means to prevent reverse rotation and said rack and pinion preventing return of said lever to the first position until fully moved to the second position.

2. The machine of claim 1 wherein the width of said slot can be adjusted to accommodate articles of different thicknesses.

3. The machine of claim 1 wherein the articles rest on a bottom member and having a weal spring member over the opening of said slot, whereby the foremost article rests on said spring member and a support plate mounted under and supporting said weak spring member, and means actuated by said lever to release said support plate whereby heavy papers will not overload said weak spring member.

4. The machine of claim 1 wherein all of the mechanism is mounted in a drawer-like member in a cabinet whereby the mechanism can be slid into said cabinet for dispensing articles and extended out of said cabinet for loading and having catch means between said cabinet and said pressure plate, said catch means engaging the pressure plate and preventing it from extending beyond the front of the cabinet when the drawer-like member is extended out of said cabinet for loading.

* * * * *